United States Patent [19]

Traumümiller et al.

[11] Patent Number: 4,572,583

[45] Date of Patent: Feb. 25, 1986

[54] CUTTING HEAD FOR DRIFT ADVANCING MACHINES AND PROCESS FOR PRODUCING SAME

[75] Inventors: Gottfried Traumümiller; Wilfried Maier, both of Zeltweg; Franz Schöffmann, Leoben; Herwig Wrulich, Zeltweg, all of Austria

[73] Assignee: Voest-Alpine Aktiengesellschaft, Vienna, Austria

[21] Appl. No.: 528,788

[22] Filed: Sep. 2, 1983

[30] Foreign Application Priority Data

Sep. 3, 1982 [AT] Austria ..... 3310/82

[51] Int. Cl.[4] ..... E21C 7/08; E21F 5/02

[52] U.S. Cl. ..... 299/81; 228/166

[58] Field of Search ..... 299/81; 228/168, 169, 228/165, 244, 204, 167; 175/339

[56] References Cited

U.S. PATENT DOCUMENTS

| | | | |
|---|---|---|---|
| 3,374,033 | 3/1968 | Arentzen | 299/81 |
| 3,563,324 | 2/1971 | Lauber | 299/81 |
| 4,255,641 | 3/1981 | Connell et al. | 228/169 |
| 4,289,357 | 9/1981 | Hintermann et al. | 299/81 |

*Primary Examiner*—Stephen J. Novosad
*Assistant Examiner*—Michael Goodwin
*Attorney, Agent, or Firm*—Cushman, Darby & Cushman

[57] ABSTRACT

For the supply of water to nozzles on the circumference of a cutting head there are, within a cutting head (1) composed of individual discs (2), provided bores (14 respectively 16) extending in direction to the axis of rotation of the cutting head (1). The individual annular discs (2) are connected one with the other by welding, the weld beads extending over a radial area (a) of the cutting head which is greater than the diameter (b) of the bores (14 respectively 16). The bores (14 respectively 16) extend through the weld beads (19) (FIG. 2).

8 Claims, 3 Drawing Figures

CUTTING HEAD FOR DRIFT ADVANCING MACHINES AND PROCESS FOR PRODUCING SAME

Figure 1:
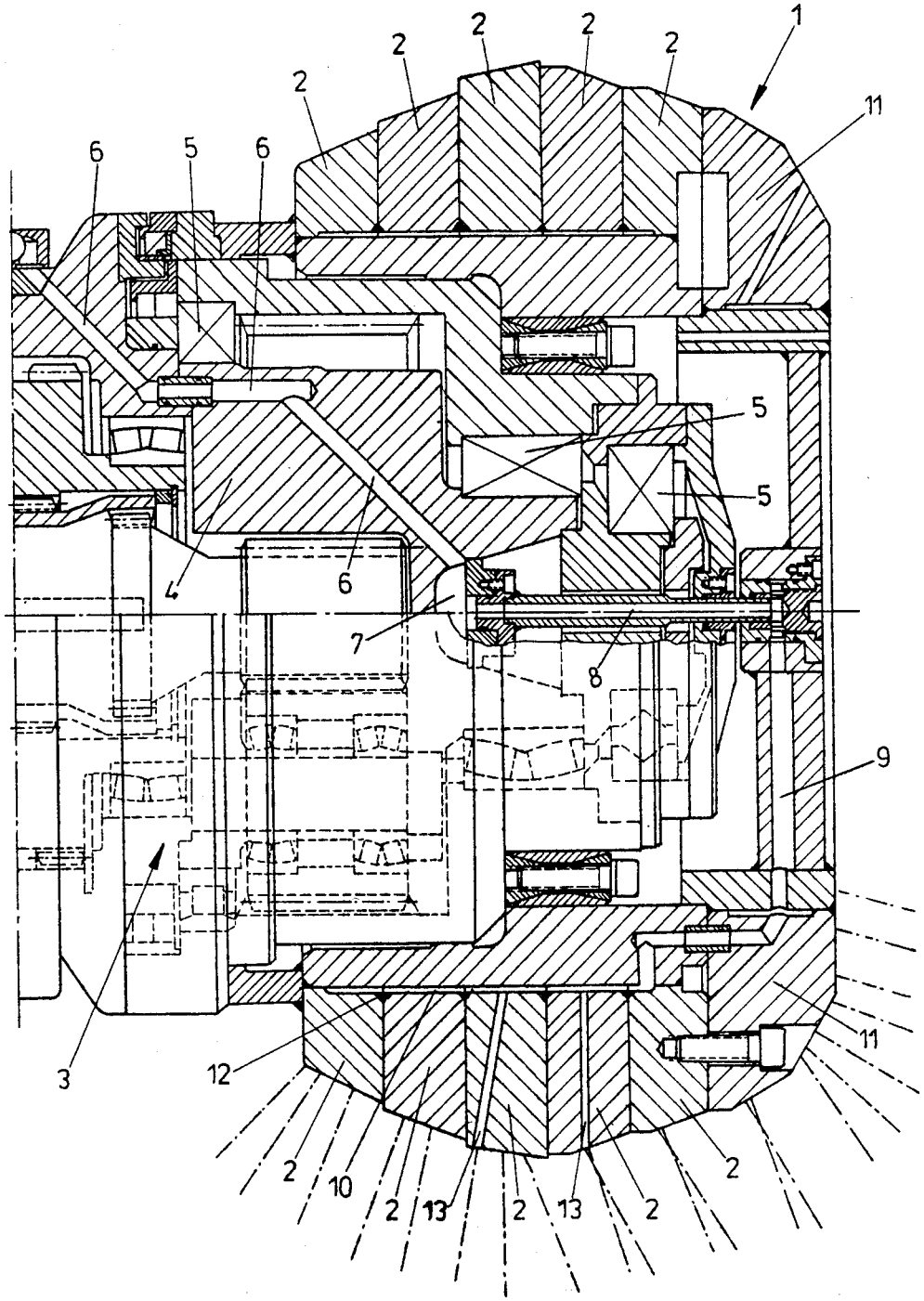
FIG. 1 PRIOR ART

The invention refers to a cutting head for drift advancing machines and comprising bits arranged on its circumference and having outlet nozzles for the discharge of cooling water, which outlet nozzles can be supplied with water via passages extending within the cutting head in axial direction, the cutting head base member consisting of annular discs adjoining each other in axial direction and being mutually connected by welding. The invention further refers to a process for producing such a cutting head.

The exit nozzles for the discharge of cooling water can also be used to spray water for the purpose of dust-precipitation, and a plurality of constructions have become known in which such exit nozzles are connected to the bit holder. With these constructions, supply of water can be shut off or given free by means of valves cooperating with the bits but also other control equipment can be used for controlling the supply of water. In each case it is necessary to equip the cutting head base member with corresponding passages to make possible supply of water to the individual nozzles. For this purpose, an axial water supply passage is, as a rule, provided and AT-PS No. 359 453 discloses an embodiment in which distribution of water to the nozzles is effected via a substantially cylindrical annular cavity extending in axial direction of the cutting head. The cutting head base member consists in most cases of cheap ferritic constructional steel and is thus subject to corrosion. With the known embodiment, relatively high surface pressures became effective within the substantially cylindrical cavity in radial direction thereof if water was supplied under high pressure.

On account of the sensitivity of the cutting head base member to corrosion and in particular on account of the sensitivity to corrosion of the welding areas between adjacent annular discs forming an internal wall of the cylindrical cavity there result, with the known embodiment, sealing problems. Corrosion at the welding areas resulted in some cases to leakage within the region of the welding areas and with high water supply pressures there existed the danger of destruction of the cutting head base member by severing along the front surfaces of adjacent annular discs.

The invention now aims at further developing a cutting head of the initially mentioned type such that tightness is warranted with high supply pressures and the danger of corrosion at the welding areas is reduced. For solving this task the invention essentially consists in that the passages extending within the cutting head in axial direction thereof are designed as bores extending through the weld bead of adjacent discs of the cutting head base member. In view of the passages extending in axial direction of the cutting head being designed as bores, lower radial forces are, with higher supply pressures, acting in the sense of expanding the cutting head than is the case with a cylinder mantle. In view of the bores extending through weld beads of adjacent discs, there results surprisingly a reduction of the corrodibility at the area of these weld beads, which is attributed to the smooth internal surface of the bore within the area of the weld bead, said smooth surface reducing the corrosive attack as compared with the rough surface of the weld bead in the known embodiment. Above all it is to be considered that with a water supply pressure of, for example, 300 bar and thereby considering the surface area of the cylinder mantle of the supply cavity, the forces acting in radial direction would attain a value of 10,000,000N in the known embodiment.

A ferritic constructional steel can, in a manner known per se, be used as the cutting head base member and welding together of adjacent annular discs can be effected by melting down ferritic electrodes, which is favourable considering costs. For uniformly supplying water to the exit nozzles distributed over the circumference of the cutting head, the arrangement is, according to the invention, such that there are provided, in circumferential direction of the cutting head, at least three bores extending in substantially parallel relation to the axis of the cutting head and being closed at the front surfaces of the cutting head.

The inventive process for producing such a cutting head is essentially characterized in that at least one of mutually facing front surfaces of the annular discs is, at the area of adjacent inner edges of the annular discs of the cutting head base member to be connected by welding, chamferred or stepped over a radial area having a greater radial width than is the diameter of the bores extending in axial direction, in that the annular discs are, by filling the cavity thus formed, connected by welding and in that the bores extending in axial direction of the cutting head are, after having connected the discs one with the other, bored through these weld beads. By said chamfer or, respectively, recess at at least one of the adjacent front surfaces of the annular discs there is formed a sufficiently great radial area within which the welding electrode can be melted down, thus making sure that during subsequent boring operation for producing the supply passages the bore produced actually extends through the weld bead. The radial width of the chamfer or, respectively, recess must thus be greater than is the diameter of the bore subsequently to be machined.

Figure 2:
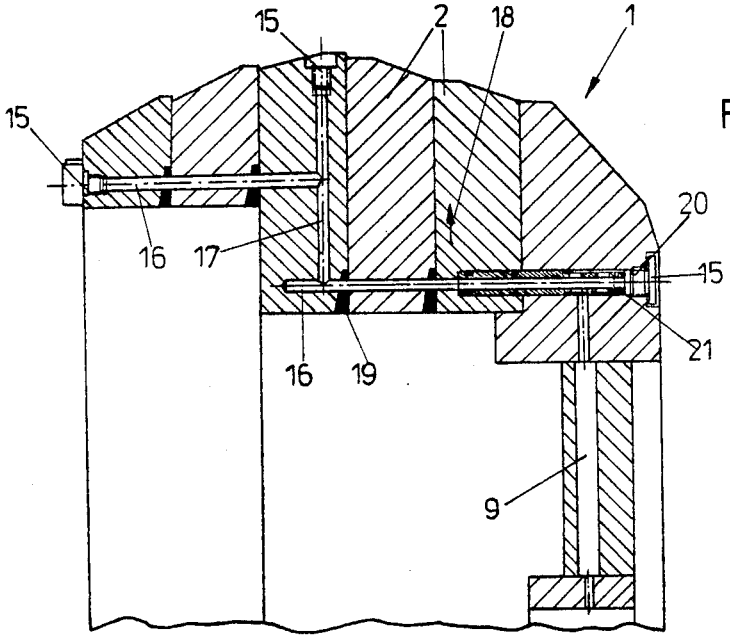
Figure 3:
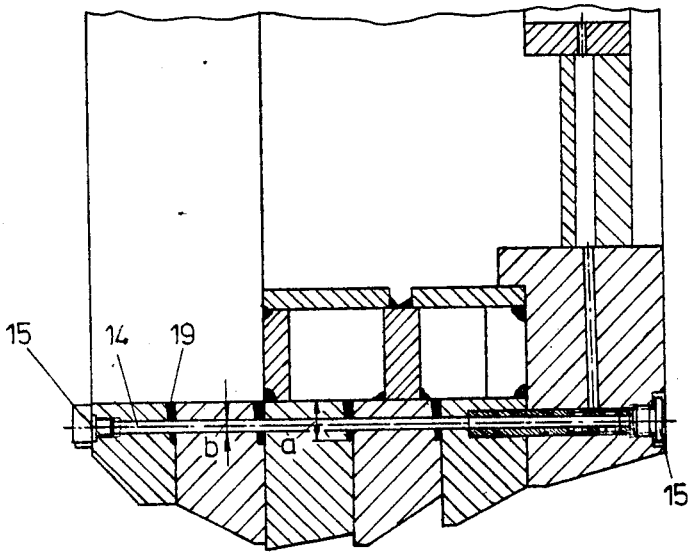

In the following, the invention is further illustrated with reference to the drawing, in which FIG. 1 shows an axial section through a cutting head of the prior art and FIGS. 2 and 3 show analogous sections through two embodiments.

In FIG. 1, the cutting head 1 is set up of mutually welded discs 2 and rotatably supported on a cutting arm not shown. The last stage of the reduction gear is indicated in dashed lines and designated 3. Bearing support of the cutting head 1 on a carrier connected with the cutting arm is effected by means of antifriction bearings 5.

The water supplied flows first via passages 6 within the carrier 4 and then into a distributing chamber 7 and subsequently via an axial supply conduit 8, which is correspondingly sealed, and via radial conduits 9 into the distributing cavities 10 extending in axial direction of the cutting head. The front plate 11 of the cutting head 1 is connected with the base member of the cutting head by means of screws. The weld beads of adjacent annular discs are at an internal wall of the annular space 10 subject to corrosive attack by the water supplied. From the annular cavity 10, the water arrives, via substantially radial bores 13, at the exit nozzles which can be housed within the bit holder.

In the embodiments according to FIGS. 2 and 3 there are, in place of the annular cavity 10, provided at least three bores 14 extending over the whole axial extension of the cutting head and being closed at both sides by closure members 15. If geometry of the cutting head requires, the arrangement can, as is shown in the upper part of FIG. 2, also be such that the bore 14 is subdivided into two bores 16 which are mutually connected by means of a radial bore 17. Also with such an embodiment the bores 14 or, respectively, 16 can be cleaned after having removed the closure members 15. Supply of water to these bores 14 or, respectively, 16, at least three of which are distributed over the circumference of the cutting head 1, can be effected in a substantially analogous manner as in the embodiment according to FIG. 1 and is not shown again.

The individual discs 2 are connected one with the other by welding with their front surfaces, noting that one respective disc 2 has a recess extending in radial direction indicated by the arrow 18, said recess extending over a partial area a. This partial area a is greater than the diameter b of the bores 14 and, respectively, 16 and is filled by melting an electrode when connecting the individual discs. The bores 14 and, respectively, 16 are now passed through the weld beads, which are designated 19, so that there results a smooth internal surface as the wall of the bore. The closure members 15 have a thread 20 which is screwed into a corresponding internal thread 21 at the front sides of the bores 14 and, respectively, 16. The essentially radially extending tap conduits 13 leading to the exit nozzles and shown in FIG. 1 open into these bores 14 and, respectively, 16. Such an embodiment is, on account of the lower pressure becoming effective in radial direction, also suitable for supplying pressurized water to the exit nozzles under a pressure of up to 300 bar without running the risk to subject to mechanically excessive stress the weld beads 19 between adjacent annular discs 2.

What is claimed is:

1. A cutting head for drift advancing machines comprising a cutting head base, said base comprising a plurality of adjacent hollow annular disc-shaped bits, the bits abutting one another along their axial faces and welded together along their innermost abutting surfaces thereby forming a weld bead, the bits further comprising a radial passage extending through the bit for discharging a cooling fluid from the bit, said radial passage connected to an axially arranged bore which extends through the bits and the weld bead.

2. A cutting head according to claim 1, wherein a plurality of axial bores are provided and arranged essentially parallel to one another and spaced circumferentially about the axis of the cutting head.

3. A cutting head according to claim 2 wherein the axial bores are spaced equidistant from one another and the axis of cutting head.

4. A cutting head according to claim 1 wherein the axial bore is closed at each end.

5. A process for producing a cutting head wherein the cutting head comprises a plurality of annular disc-shaped bits arranged with their radial faces abutting each other, each of the bits having at least one radially extending fluid passage for cooling fluid to be discharged at the perimeter of the bits, the bits further having at least one chamfered face at the inner edge, the method comprising welding the bits together at their innermost edge thereby forming a weld bead in the cavity formed by the chamfered face, boring at least one hole axially through the welded bit such that the hole extends through the weld beads and connects with the radial passage whereby cooling fluid supplied to the axial hole passes through the radial passages and is discharged at the perimeter of the bit.

6. The process according to claim 5 wherein the chamfered face and the weld bead have a radial width greater than the bored axial hole.

7. The process according to claim 6, wherein the bored axial hole has a smooth inner surface thereby reducing corrosive attack on the welds.

8. The process according to claim 5, wherein the axial hole is closed at both ends by a closure member.

* * * * *